US007845202B2

(12) United States Patent
Padilla et al.

(10) Patent No.: US 7,845,202 B2
(45) Date of Patent: Dec. 7, 2010

(54) INTERCHANGEABLE ELECTROMECHANICAL LOCK CORE

(75) Inventors: Toby Padilla, Denver, CO (US); Bertrand Roland, Hamburg (DE); Vladimir Shvarts, Plano, TX (US)

(73) Assignee: Assa Abloy AB, Stockholm (SE)

( * ) Notice: Subject to any disclaimer, the term of this patent is extended or adjusted under 35 U.S.C. 154(b) by 0 days.

(21) Appl. No.: 11/534,518

(22) Filed: Sep. 22, 2006

(65) Prior Publication Data

US 2008/0072637 A1 Mar. 27, 2008

(51) Int. Cl.
*E05B 9/04* (2006.01)

(52) U.S. Cl. ..... 70/371; 70/278.1

(58) Field of Classification Search ..... 70/371, 70/278.1, 277, 278.2, 278.3, 278.7, 279.1, 70/283.1, 367, 368, 369
See application file for complete search history.

(56) References Cited

U.S. PATENT DOCUMENTS 3,009,349 A * 11/1961 Check ..... 70/369
3,713,311 A * 1/1973 Oliver et al. ..... 70/369
4,073,527 A 2/1978 Schlage
4,123,926 A 11/1978 Elder
4,386,510 A 6/1983 Best et al.
4,810,014 A 3/1989 McGourty et al.
4,832,385 A 5/1989 Llort
4,856,310 A 8/1989 Parienti
4,901,545 A 2/1990 Bacon et al.
4,939,915 A 7/1990 Vonlanthen
4,953,373 A 9/1990 Toledano
5,010,750 A 4/1991 Boser et al.
5,027,629 A 7/1991 Liu
5,542,274 A * 8/1996 Thordmark et al. ..... 70/495
5,628,217 A 5/1997 Herrera
5,826,450 A 10/1998 Lerchner et al.
5,839,305 A 11/1998 Aston
5,848,541 A 12/1998 Glick et al.
5,946,956 A 9/1999 Hotzl
6,079,238 A 6/2000 Hoffmann et al.
6,079,240 A 6/2000 Shvarts
6,101,856 A * 8/2000 Pelletier et al. ..... 70/472
6,158,259 A 12/2000 Schmitz et al.
6,264,256 B1 7/2001 Hankel et al.
6,286,347 B1 9/2001 Frolov
6,301,942 B1 10/2001 Shvarts (Continued)

FOREIGN PATENT DOCUMENTS

DE 19525196 1/1997

(Continued)

OTHER PUBLICATIONS

U.S. Appl. No. 11/534,509, filed Sep. 22, 2006, Padilla.

(Continued)

*Primary Examiner*—Peter M Cuomo
*Assistant Examiner*—Kristina R Fulton
(74) *Attorney, Agent, or Firm*—Sheridan Ross P.C.

(57) ABSTRACT

The invention concerns an electromechanical lock. More specifically, the invention concerns an interchangeable electromechanical lock core that is equipped with a blocking cam that secures the lock core in a mating housing. The blocking cam may be coupled to a plug and the plug may be coupled to a knob. Once both couplings have occurred, the knob can be turned to actuate the blocking cam.

22 Claims, 7 Drawing Sheets

U.S. PATENT DOCUMENTS

| | | | | |
|---|---|---|---|---|
| 6,334,347 | B1 | 1/2002 | Iscla | |
| 6,374,653 | B1 * | 4/2002 | Gokcebay et al. | 70/278.3 |
| 6,474,122 | B2 | 11/2002 | Davis | |
| 6,487,884 | B1 | 12/2002 | Constantinou | |
| 6,523,377 | B1 | 2/2003 | Vonlanthen | |
| 6,526,791 | B2 | 3/2003 | Shvarts | |
| 6,564,600 | B1 | 5/2003 | Davis | |
| 6,564,601 | B2 * | 5/2003 | Hyatt, Jr. | 70/278.3 |
| 6,578,396 | B2 * | 6/2003 | Field et al. | 70/371 |
| 6,604,394 | B2 | 8/2003 | Davis | |
| 6,615,625 | B2 | 9/2003 | Davis | |
| 6,640,594 | B1 | 11/2003 | Yao | |
| 6,651,468 | B2 | 11/2003 | Aramburu et al. | |
| 6,718,806 | B2 | 4/2004 | Davis | |
| 6,725,693 | B2 | 4/2004 | Yu et al. | |
| 6,826,935 | B2 * | 12/2004 | Gokcebay et al. | 70/278.3 |
| 6,840,072 | B2 * | 1/2005 | Russell et al. | 70/278.3 |
| 6,865,916 | B2 | 3/2005 | Goldman | |
| 6,895,792 | B2 | 5/2005 | Davis | |
| 2002/0187307 | A1 | 12/2002 | Tanaka et al. | |
| 2003/0200778 | A1 | 10/2003 | Chhatwal | |
| 2004/0159135 | A1 | 8/2004 | Kato et al. | |
| 2005/0265796 | A1 | 12/2005 | Persson | |
| 2006/0213240 | A1 * | 9/2006 | Krisch et al. | 70/278.7 |

FOREIGN PATENT DOCUMENTS

| | | |
|---|---|---|
| DE | 29703559 | 4/1997 |
| DE | 19603320 | 8/1997 |
| DE | 19851308 | 5/1999 |
| DE | 19822865 | 11/1999 |
| DE | 19919283 | 12/1999 |
| DE | 19854879 | 8/2000 |
| DE | 19930054 | 1/2001 |
| DE | 10100787 | 7/2002 |
| DE | 10163355 | 3/2003 |
| DE | 10225368 | 7/2003 |
| DE | 10328297 | 1/2005 |
| EP | 0243586 | 11/1987 |
| EP | 0453878 | 10/1991 |
| EP | 0899399 | 3/1999 |
| EP | 0924369 | 6/1999 |
| EP | 1022415 | 7/2000 |
| EP | 1065335 | 1/2001 |
| EP | 1079051 | 2/2001 |
| EP | 1174572 | 1/2002 |
| EP | 1256671 | 11/2002 |
| EP | 1378620 | 1/2004 |
| EP | 1679414 | 7/2006 |
| WO | WO 02/088492 | 11/2002 |
| WO | WO 03/097970 | 11/2003 |
| WO | WO2005/001224 | 1/2005 |

OTHER PUBLICATIONS

U.S. Appl. No. 11/424,437, filed Jun. 15, 2006, Lange.
U.S. Appl. No. 11/424,436, filed Jun. 15, 2006, Lange.
Official Action for U.S. Appl. No. 10/562,166, mailed Dec. 26, 2007.
Official Action for U.S. Appl. No. 11/534,209, mailed Nov. 1, 2007.
European Search Report and Opinion for European Patent Application No. 07116799.3, dated Sep. 15, 2008.
Official Action for U.S. Appl. No. 11/424,436, mailed Oct. 24, 2008.
Computer Generated Translation of WO 02/088492 A2, European Patent Office Website, http://gb.espacenet.com/search97cgi/s97__cgi.exe? Action=FormGen& Tem plate=gb/EN/home.hts.
Official Action for U.S. Appl. No. 10/562,166, mailed Feb. 19, 2009.
Official Action for U.S. Appl. No. 11/424,437, mailed Dec. 12, 2008.
Official Action for U.S. Appl. No. 11/534,209, mailed Apr. 1, 2009.
Official Action for U.S. Appl. No. 11/424,436, mailed Apr. 24, 2009.
Official Action for U.S. Appl. No. 10/562,166, mailed Sep. 2, 2009.
Official Action for U.S. Appl. No. 11/424,436, mailed Nov. 24, 2009.
Restriction Requirement for U.S. Appl. No. 11/424,437, mailed Oct. 5, 2009.
Official Action for U.S. Appl. No. 11/534,209, mailed May 1, 2008.

* cited by examiner

INTERCHANGEABLE ELECTROMECHANICAL LOCK CORE

FIELD OF THE INVENTION

The invention concerns an electromechanical lock core. More specifically, one aspect of the invention concerns an interchangeable electromechanical lock core that has a blocking cam controlled at least in part by a contactless reader and valid contactless credential.

BACKGROUND OF THE INVENTION

The technology of interchangeable lock cores has been traditionally controlled by mechanical mechanisms such as keys, pins, tumblers, and the like. When a key, or sometimes a master key, is lost or otherwise compromised it is sometimes necessary to replace each lock to which the compromised key had access. This particular process involves utilizing either a locksmith or other maintenance personnel to rekey or replace the interchangeable core with another core, and then requires the creation and redistribution of new keys. The compromise of a mechanical key in traditional security systems creates a considerable security risk and inconvenience.

The use of Radio Frequency Identification (RFID) technology has gained popularity for many reasons. One such reason is the ease with which an access control system can be maintained. For example, if an access control credential (e.g., a smartcard, proximity card, key fob, cellular phone, Personal Digital Assistant (PDA), or the like) is compromised, the access control points (i.e., credential readers that control access to a controlled asset, such as a doorway) simply require a reprogramming of their access permissions. The reprogramming of access permissions in an electronic access control reader can be accomplished from a central control station with the push of a button, or by simply presenting the reader with a reprogramming card. This makes RFID and other contactless access control technologies desirable over traditional mechanical interfaces. RFID access control technologies are also superior to mechanical locks because a number of different card combinations and encryption methods can be used to increase security whereas the security of mechanical locks can often be bypassed with a pick.

However, the installed base of mechanical locks, including interchangeable mechanical locks, is so entrenched that customers will likely not replace their mechanical locks with electromechanical locks unless such replacement is relatively easy and inexpensive. This means that customers may only be persuaded to upgrade to electromechanical locks if the new lock can utilize portions of the previous mechanical lock. Additionally, the security offered by the electromechanical lock should be appropriate to justify the upgrade.

SUMMARY OF THE INVENTION

It is thus one aspect of the present invention to provide an electromechanical lock, and more specifically an interchangeable electromechanical lock core, that can readily replace a mechanical interchangeable lock core. In one embodiment, an electromechanical lock core is provided that can be inserted into an existing housing that previously contained an older interchangeable lock core. Once inserted, a contactless control credential is used to lock the interchangeable lock core into place within the housing. At this point the mechanical interchangeable lock core has been upgraded to a contactless reader capable of controlling access to the door. The electromechanical lock core can be removed from the housing with the control credential to replace batteries or to perform other maintenance tasks, but the lock core does not need to be replaced whenever a general access credential has been compromised.

In accordance with one embodiment of the present invention, an electromechanical lock core is provided that includes a plug and a blocking cam. The blocking cam secures the lock core within a lock housing connected to the door. To permit movement of the blocking cam an actuator is used to couple the blocking cam to the plug. Only when the blocking cam is coupled to the plug may the lock core be removed from and inserted into the lock housing.

To couple the blocking cam to the plug, coupling means such as, pins, gears, friction drives, chains, belts, or any other positive engagement mechanisms can be employed.

A sensor detects the coupling between the plug and blocking cam and sends a confirmation of the same to the credential reader, which may be located in a knob or in other locations around the lock core. With confirmation that the blocking cam is coupled to the plug, the reader, in one embodiment, only allows the plug to be moved when a control credential is presented to the reader. If no control credential is presented to the reader, then movement of the plug is denied and the blocking cam is not allowed to move.

In one embodiment, the blocking cam is coupled to the plug via a moveable coupling pin. Movement of the coupling pin is controlled by movement of the actuator which causes the blocking cam to be mechanically connected to or unconnected from the plug. Assuming that a proper control credential is presented to the reader, and the plug and blocking cam are properly coupled, then the plug can be rotated to adjust the position of the blocking cam. If a proper control credential is not presented, the plug will not rotate and blocking cam will not move from first position. When the blocking cam is in a first position it restricts movement of the entire lock core within the lock housing, but when the blocking cam is moved to a second position, the lock core may be removed from the lock housing.

One preferred feature of the electromechanical part of the invention is that in a rest position, the knob is freely turnably arranged on said plug and that electromechanically driven locking means are provided in said plug or in said knob for, in an operating position, coupling the plug with the knob. With that, the rotating parts can be easily adapted to the locking mechanism. This functionality may be used in many different kinds of doors or lock housings and is not just limited to use in interchangeable lock cores.

In accordance with other embodiments of the present invention a method of allowing removal and/or insertion of an interchangeable electromechanical lock core from and/or to a lock housing is provided. The method generally includes the steps of:

(a) causing a blocking cam to be coupled to a plug;

(b) presenting a valid contactless control credential to said contactless reader in said lock core; and then (c) moving said plug such that said blocking cam is moved from a first position that limited movement of said lock core from or into said lock housing, to a second position that allows movement of said core from or to said lock housing.

BRIEF DESCRIPTION OF THE DRAWINGS

The invention is described below in detail with the help of the attached schematic drawings wherein.

DETAILED DESCRIPTION OF THE INVENTION

Figure 1:
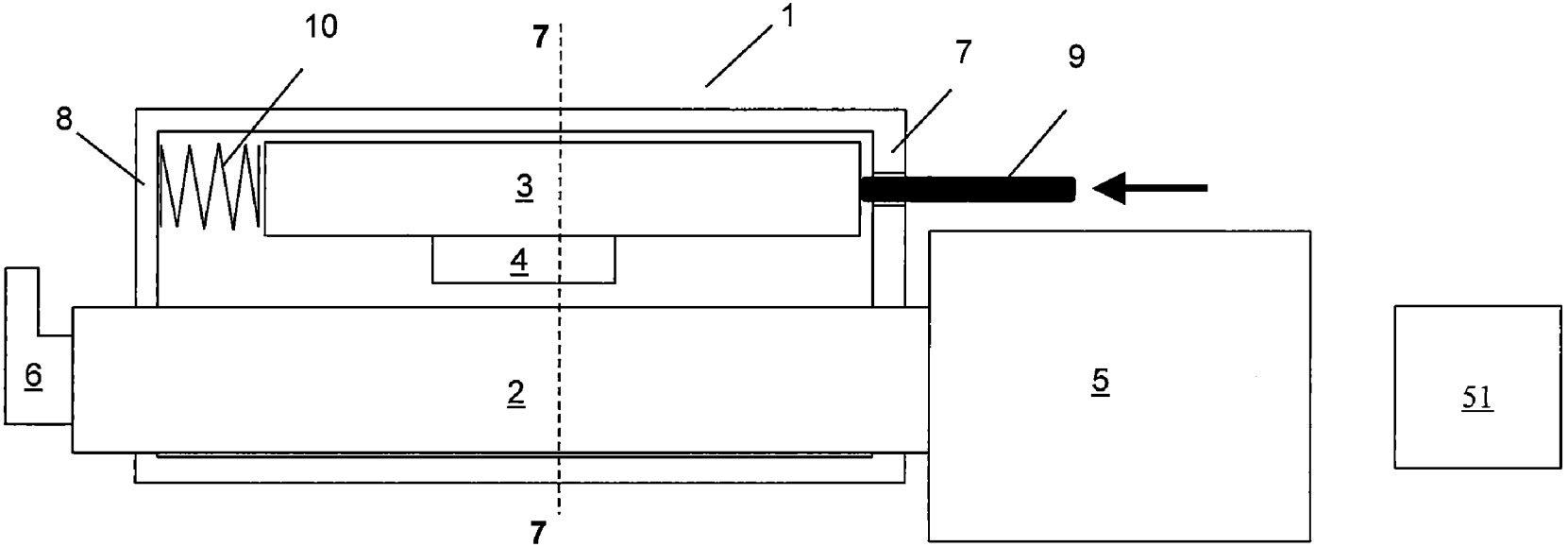
FIG. 1 is a longitudinal sectional view of an electromechanical interchangeable lock core in accordance with embodiments of the present invention.

FIG. 1 depicts an interchangeable electromechanical lock core in accordance with at least some embodiments of the present invention. The lock core generally comprises a shell 1 that holds various components of the lock core. Such components that may be held by the shell 1 include a plug 2, a blocking plug 3, a blocking cam 4, a knob 5, and an operating cam 6. The plug 2 has a front end and a back end. The front end of the plug 2 is selectively mechanically coupled to the knob 5. The back end of the plug 2 is mechanically connected to the operating cam 6. However, the mechanical coupling between the plug 2 and knob 5 is selectively engaged only upon presentation of a proper credential 51 to the knob 5. In one embodiment, the credential 51 includes an RF transponder capable of transferring data to and from a credential reader without contact. The RF transponder may be carried in a number of different form factors including, without limitation, a smartcard, a proximity card, a key fob, a passport, a credit card, a cellular phone, a PDA, or any other type of known contactless credential 51.

When a proper credential 51 is not presented to the knob 5, the knob 5 rotates freely around the plug 2 without engaging and causing the plug 2 to rotate. When a proper credential 51 is presented to the knob 5, the knob 5 is engaged to the plug 2, and the rotation of the knob 5 causes the operating cam 6 to rotate and engage/disengage a door lock or other type of security mechanism.

The blocking cam 4 is used to secure the contents of the core within a lock housing, such as on a door. When the blocking cam 4 is in a first position the core is held securely within the door. When the blocking cam 4 is in a second position the core is removable from the lock housing of the door. The position of the blocking cam 4 is controlled by the rotation of the plug 2, which is in turn dependent upon the coupling between the plug 2 and the knob 5. Both the blocking cam 4 and the knob 5 have to be mechanically coupled to the plug 2 in order to manipulate the position of the blocking cam 4 to thereby permit removal from and insertion of the core within the lock housing.

The blocking cam 4 can be coupled to the plug 2 in a number of different ways. Coupling means such as, pins, gears, friction drives, chains, belts, or any other positive engagement mechanisms can be employed. Pressing an actuator 9 toward a rear face 8 of the shell 1 typically effects the engagement of the blocking cam 4 to the plug 2 through a coupling means. As will be described in detail below, the actuator 9 can cause the blocking cam 4 to be coupled to the plug 2. The mere coupling of the blocking cam 4 to the plug 2, in most configurations, is not sufficient to allow manipulation of the position of the blocking cam 4. Rather, the knob 5 must also be coupled to the plug 2 while the blocking cam 4 is coupled to the plug 2. As can be appreciated, the actuator 9 can be any type of known actuator that is external, internal, integrated, and/or separate to the lock core.

Figure 2:
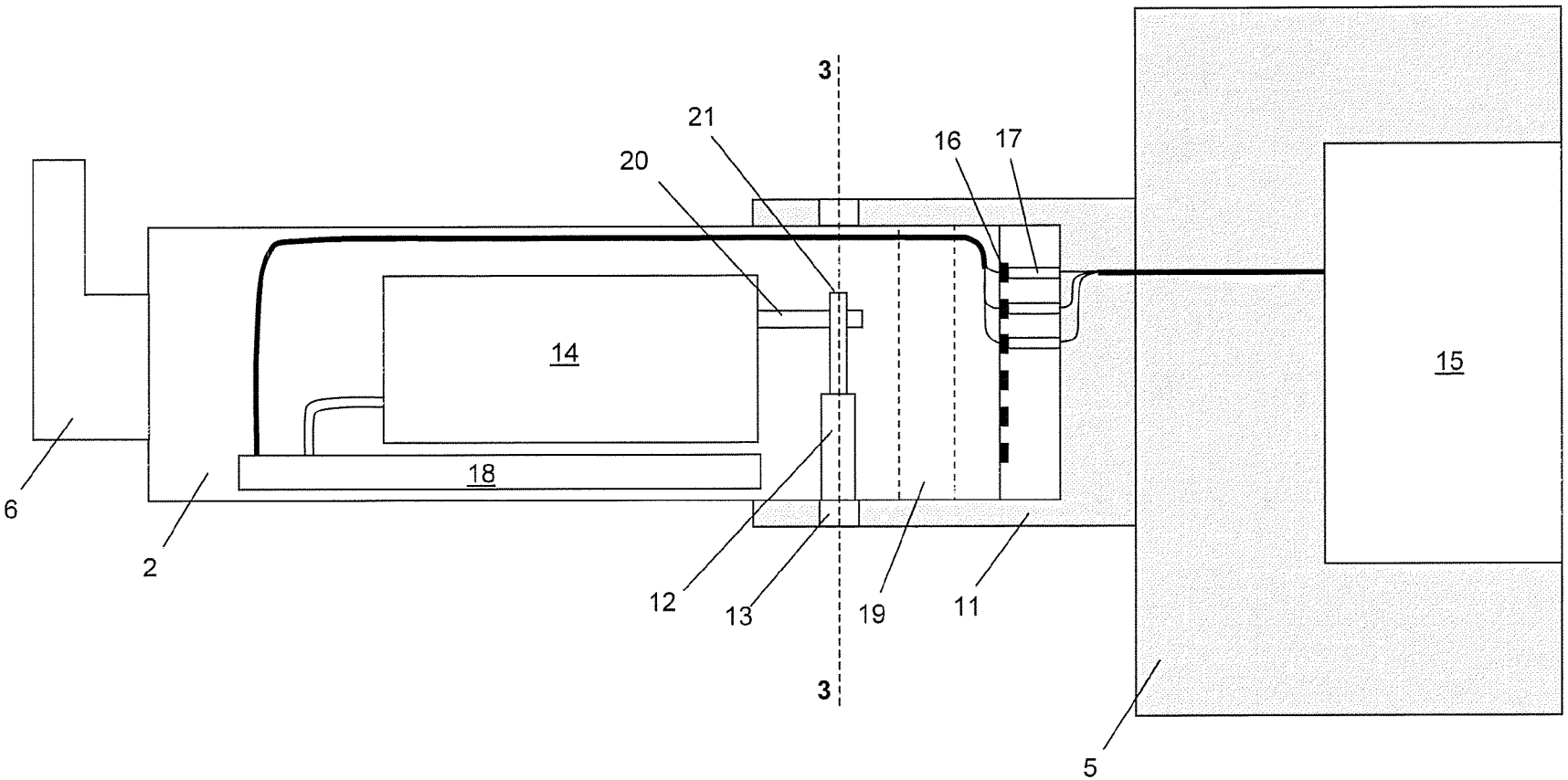
FIG. 2 is a longitudinal sectional view of electromechanical portions of the lock core of FIG. 1.
Figure 3:
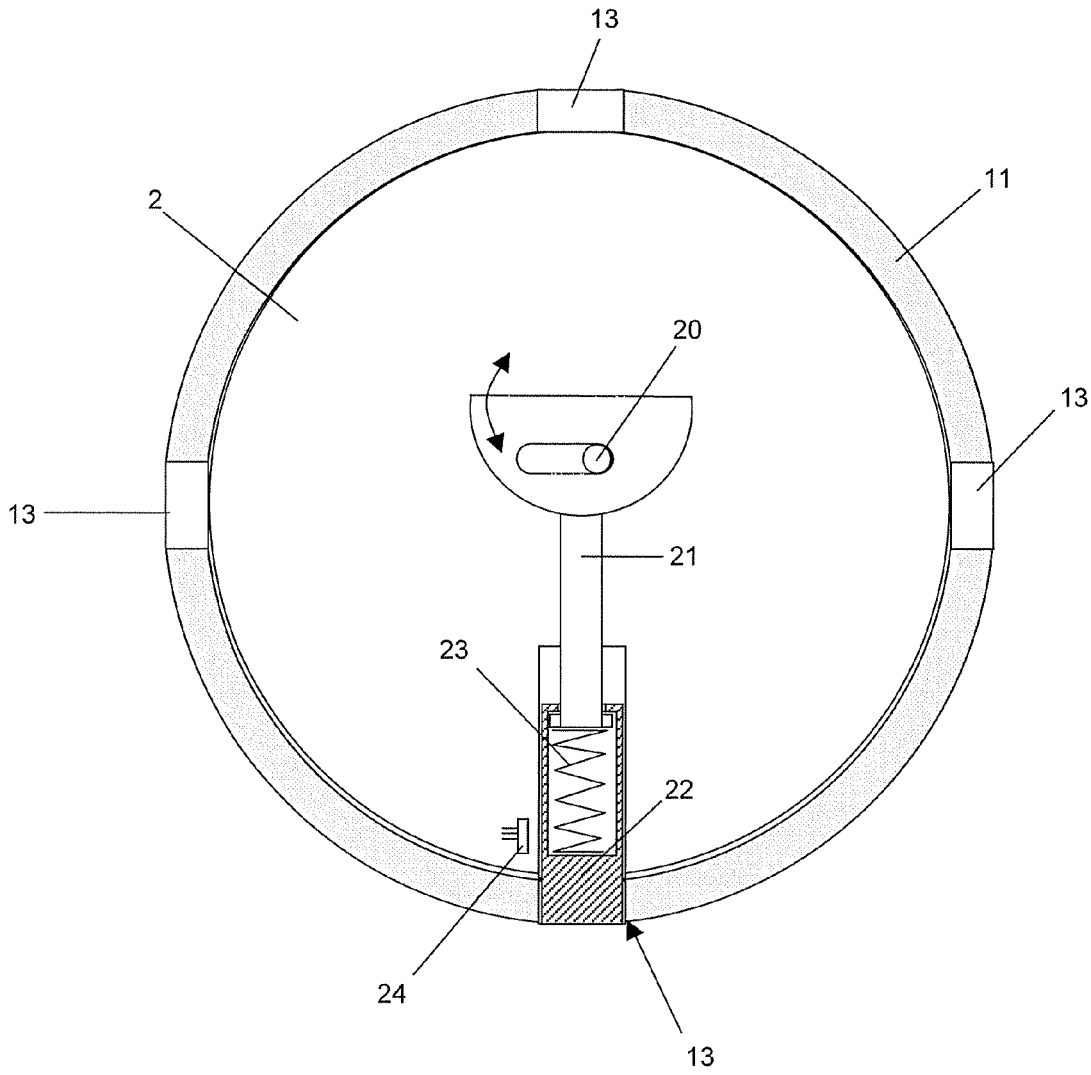
FIG. 3 is a cross-sectional view along line 3-3 in FIG. 2.

FIGS. 2 and 3 show electromechanical portions of the lock core of FIG. 1. The plug 2 is provided with an operating cam 6 on the one end and a knob 5 on the other end. The operating cam 6 is firmly connected to the plug 2. The knob 5 serves for turning the plug in the shell 1. The knob 5 can freely rotate on the plug 2 or it may engage and rotate the plug 2. There are fixing means provided which hold the knob 5 on the plug 2 and which hold the plug 2 and knob 5 on the shell 1 in axial direction.

The lock core is further provided with electronic access control 15, which generates an authorization signal after receiving an access signal from a credential. The access signal may be transmitted via wireless communication. Upon generation of the authorization signal, an electric motor drive 14 arranged in a recess of the plug 2 drives a locking pin 12 into a recess or hole 13 in the socket 11 of the knob 5. The electric motor drive 14 turns an eccentric 20 that moves a rod 21 connected to the locking pin 12. With this arrangement, a connection between the knob 5 and the plug 2 is provided. The operating cam 6 can then be turned by the knob 5.

The locking pin 12 is movable in the plug 2 in radial direction between a recessed position and an extended position. The rod 21 is movable against the force of a spring 23 within a sleeve 22 of the locking pin 12. With this arrangement it is possible to move the rod 21 into its extended position or engaging position even if the locking pin 12 is not in an aligned position or directly engaging the hole 13 of the socket 11 of the knob 5. If the knob 5 is turned until the hole 13 is opposite to or aligned with the locking pin 12 as it is shown in FIG. 3 the locking pin 12 is forced into the hole 13 by the expansion of the spring 23. As shown in FIG. 3, there may be provided a plurality of locking holes or recesses 13 in the socket 11 of the knob 5. In the example of FIG. 3, an engaging position is provided each 90° along the periphery of the socket 11. A sensor 24 may be provided to detect the position of the locking pin. A sensor 24 is generally associated with each hole 13 and may be a hall sensor or any other suitable type of sensor capable of detecting the presence of the sleeve 22 in one of the holes or recesses 13. The sensor 24 then relays the presence information to the control unit 18.

The bidirectional authorization signal for operating the electric motor drive 14 is transmitted between the control unit 18 and electronic access control 15 by a slip ring arrangement. In the embodiment of FIG. 2, three contact rings 16 of increasing diameter are placed on the front face of the plug 2. There are corresponding contacts 17 provided on the inner side of the knob 5 facing the front face of the plug 2. The contacts 17 are in electric contact with the contact rings 16.

Wireless transmission of the authorization signal between the control unit 18 and the electronic access control 15 may also be possible.

The knob 5 with the electronic access control 15 can be easily changed. It is only required to provide an alternate knob 5 with the desired access control technique which can be mounted on the free end of the plug 2. For further security a drill plate 19 may be provided in front of the locking pin 12 within the plug in order to prevent drilling of the locking means. The lock housing of the lock core preferably has a size such that the locking holes 13 are covered. A protection shield (not shown) may be provided which extends to the knob such that the socket 11 cannot be reached.

For operating the lock an RF credential is held in front of the knob 5. The electronic access control unit 15 receives the access signal. After detecting the authorized signal an authorization signal is generated by the electronic access control 15 and is transmitted to the control unit 18. The control unit 18 generates an electric signal upon which the electric motor drive 14 turns the eccentric 20. The eccentric 20 extends the rod 21 radially outwards. If the sleeve 22 of the locking pin 12 is aligned with a locking hole 13 of the socket 11 of the knob, the locking pin 12 engages the recess or hole 13. The plug 2 can be turned by the knob 5.

If the sleeve 22 is not in an engaging position aligned with the recess or hole 13 the rod 21 is moved into the sleeve 22 and compresses the spring 23. The sleeve is now under compression with the effect that, upon turning the knob 5 until a recess or hole 13 of the socket 11 of the knob 5 is opposite to the sleeve 22, the sleeve 22 will be forced into the recess or hole 13. At this point, the plug 2 can also be turned by the knob 5.

After this engagement the operating cam 6 of the lock core can be turned for opening or closing the lock. It may be provided that, after a predetermined time or after the operation of the lock, a signal is generated for moving the eccentric 20 and the rod 21 to its recessed or radially withdrawn position.

The engagement of the knob 5 to the plug 2 is also needed to actuate the blocking cam 4. More specifically, the blocking cam 4 is moved by the plug 2, and the plug 2 can only be moved when the knob 5 is engaged to the plug 2. If one of the blocking cam 4 or knob 5 are not properly engaged to the plug 2 then the position of the blocking cam 4 cannot be manipulated such that the shell 1 can neither be inserted into the lock housing or removed from the lock.

Figure 4:
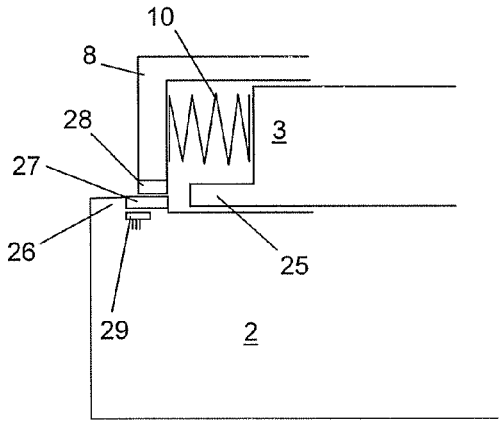
FIG. 4 is a longitudinal sectional view of the rear portion of the lock core using a coupling pin in a first position in accordance with embodiments of the present invention.
Figure 5:
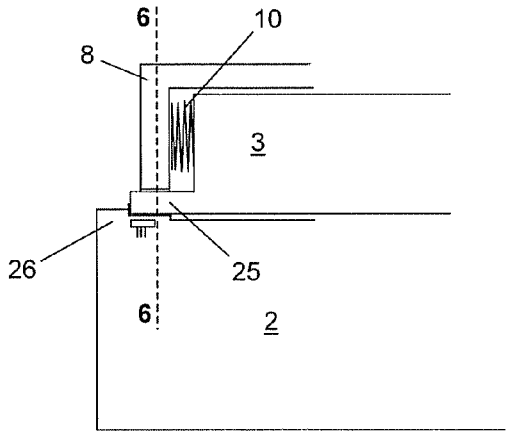
FIG. 5 is a longitudinal sectional view of the rear portion of the lock core using a coupling pin in a second position in accordance with embodiments of the present invention.

Referring now to FIGS. 4-7, a coupling of the blocking cam 4 to the plug 2 will be described in accordance with one embodiment of the present invention. In one embodiment, as can be seen in FIGS. 4 and 5 a coupling pin 25 is located on the rear end of the blocking plug 3. However, the location of the coupling pin 25 is arbitrary and may be an extension of the blocking cam 4 rather than being connected to the blocking plug 3. Movement of an actuator 9 through an access-hole located in the front face 7 of the shell 1 permits contact to be made between the actuator 9 and the blocking plug 3. Continued movement of the actuator 9 towards the rear face 8 serves to compress the spring 10 to a force and/or deflection limited position. The blocking plug 3, blocking cam 4, and coupling pin 25 move in unison and at a rate consistent with movement of the actuator 9 towards the rear face 8. Resistive forces opposing the motion of the blocking plug 3 are provided by the spring 10 as it compresses and ultimately contacts the rear face 8 of the shell 1 if the spring 10 fully compresses. As the blocking cam 4 continues to move rearward the coupling pin 25 begins to mate with a coupling pin groove 27 in the rear portion 26 of the plug 2 and a pin opening 28 in the rear face 8. The pin opening 28 and coupling pin groove 27 are designed to receive the coupling pin 25. The coupling pin 25 moves rearward until it contacts a rear portion 26 of the plug 2. Once the coupling pin 25 has contacted the rear portion 26 of the plug 2, the blocking cam 4 is adequately coupled to the plug 2. However, the blocking cam 4 may be adequately coupled to the plug 2 without having the coupling pin 25 contact the rear portion 26 of the plug 2. Upon adequate compression of the blocking plug 3 against the spring 10, the coupling pin 25 is positioned as shown in FIG. 5.

Figure 6:
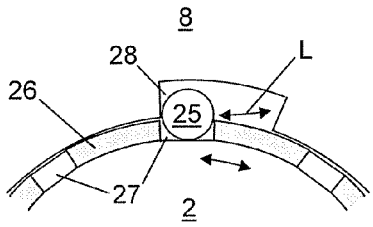
FIG. 6 is a cross-sectional view along line 6-6 in FIG.

FIG. 6 show a cross-sectional view about line 6-6 of FIG. 5. The coupling pin groove 27 is internal to the plug 2 and rotates at a rate consistent with rotation of the plug 2.

Rotation of the blocking plug 3 occurs in unison with rotation of the plug 2 and knob 5 via the coupling pin 25. This coupling can be made by any number of coupling pin grooves 27 situated radially along the perimeter of the plug 2. To prevent over-rotation of the blocking plug 3 and blocking cam 4, the coupling pin 25 is mechanically limited to length L by clearance in the pin opening 28. Additional rotation of the blocking plug 3 will causes the coupling pin 25 to contact the pin opening 28 when rotated to extremes in the clockwise or counter-clockwise directions. As a secondary mechanical feature, rotation of the blocking plug 3 is also limited to length L by physical contact of the blocking cam 4 against the inner solid surface (not shown) of the shell 1.

A sensor 29 is provided to detect the presence or absence of the coupling pin 25 in the coupling pin groove 27 and pin opening 28. In one embodiment, the sensor 29 is a hall effect sensor capable of detecting a magnetic field associated with the coupling pin 25. Any other known type of presence sensors including, without limitation, infrared sensors, friction sensors, pressure sensors, and the like may be used for the sensor 29. The sensor 29 is capable of transmitting a binary value to the control unit 18 and electronic access control 15 indicating the presence or lack thereof of the coupling pin 25 in the coupling pin groove 27.

When the presence of the coupling pin 25 is detected in the coupling pin groove 27, the sensor 29 sends an electronic signal to the control unit 18 signifying the same. When the control unit 18 receives the signal showing that the coupling pin 25 is present in the coupling pin groove 27, the control unit 18 and electronic access control 15 adjust permissions that will allow the coupling of the knob 5 to the plug 2. More specifically, a population of contactless credentials may include at least two types of credentials. The first type of credential is a general access credential that is allowed access through a door associated with the lock core. The second type of credential is a control credential that functions as an access credential and a credential that is allowed to reprogram and/or remove lock cores within the secure access system. In the situation where the presence of the coupling pin 25 is not sensed within the coupling pin groove 27 any valid credential, including general access credentials, can be used to engage the knob 5 to the plug 2. This allows a holder of the credential to open the door associated with the lock core. When the presence of the coupling pin 25 is sensed within the coupling pin groove 27, the permissions for coupling the knob 5 to the plug 2 are adjusted. Specifically, when the coupling pin 25 is within the coupling pin groove 27 the control unit 18 and electronic access control 15 restrict the connection of the knob 5 to the plug 2 to only control credentials. If a general access credential is presented to the electronic access control 15, the control unit 18 will not cause the locking pin 12 to be inserted into the recess or hole 13 and thus the knob 5 will continue to rotate freely about the plug 2. On the other hand, if a control credential is presented to the electronic access control 15, the control unit 18 will actively engage the knob 5 to the plug 2 and the knob 5 can be turned, thereby rotating the plug 2, which rotates the blocking plug 3 thus moving the blocking cam 4.

Figure 7:
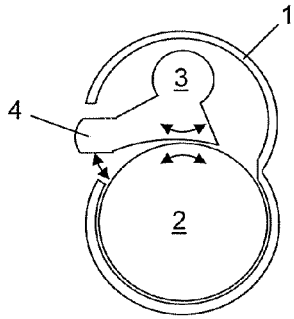
FIG. 7 is a cross-sectional view along line 7-7 in FIG. 1.

FIG. 7 depicts a cross-sectional view about line 7-7 of FIG. 1. When the coupling pin 25 is properly within the coupling pin groove 27 and a valid control credential is presented to the knob 5, the plug 2 can be rotated by rotation of the knob 5. The plug 2 rotates about an axis extending longitudinally through the center of the plug 2. Likewise, the blocking plug 3 rotates about an axis extending longitudinally through the center of the blocking plug 3. With the rotation of the blocking plug 3, the blocking cam 4 can be moved between the first and second positions thus prohibiting and/or allowing removal of and insertion of the shell 1 from or to the lock housing respectively.

Figure 8:
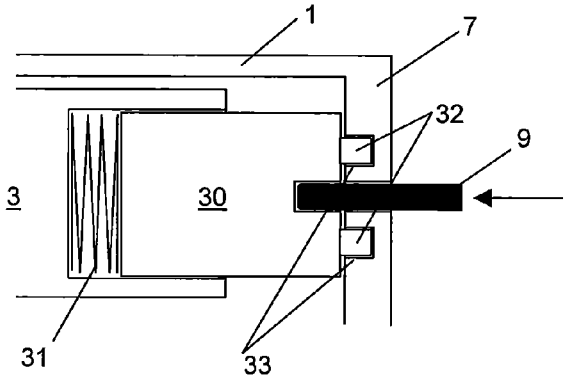
FIG. 8 is a longitudinal sectional view of a security mechanism in accordance with embodiments of the present invention.

FIG. 8 depicts a security mechanism that may be employed between the actuator 9 and the blocking plug 3. To permit rotation of the blocking plug 3 and blocking cam 4, the security mechanism, embodied by components 30, 31, 32, and 33, must be decoupled from the front face 7 of the shell 1. When the actuator 9 is moved through the access-hole in the front face 7, contact is first made with the piston 30. The piston 30 is rigidly coupled (not shown) to the blocking plug 3 so that motion between the piston 30 and blocking plug 3 is in unison in the radial direction. Movement of the piston 30 via the actuator 9 towards the blocking plug 3 serves to compress the piston spring 31 at a rate greater than the compression rate of the spring 10. Adequate compression of the piston spring 31 decouples the anti-rotation pins 32 from the anti-rotation receptacles 33 located in the front face 7. When the actuator 9 has pressed the blocking plug 3 far enough such that the coupling pin 25 is within the coupling pin groove 27, the blocking plug 3 and piston 30 are allowed to rotate about their collinear central axes.

Figure 9:
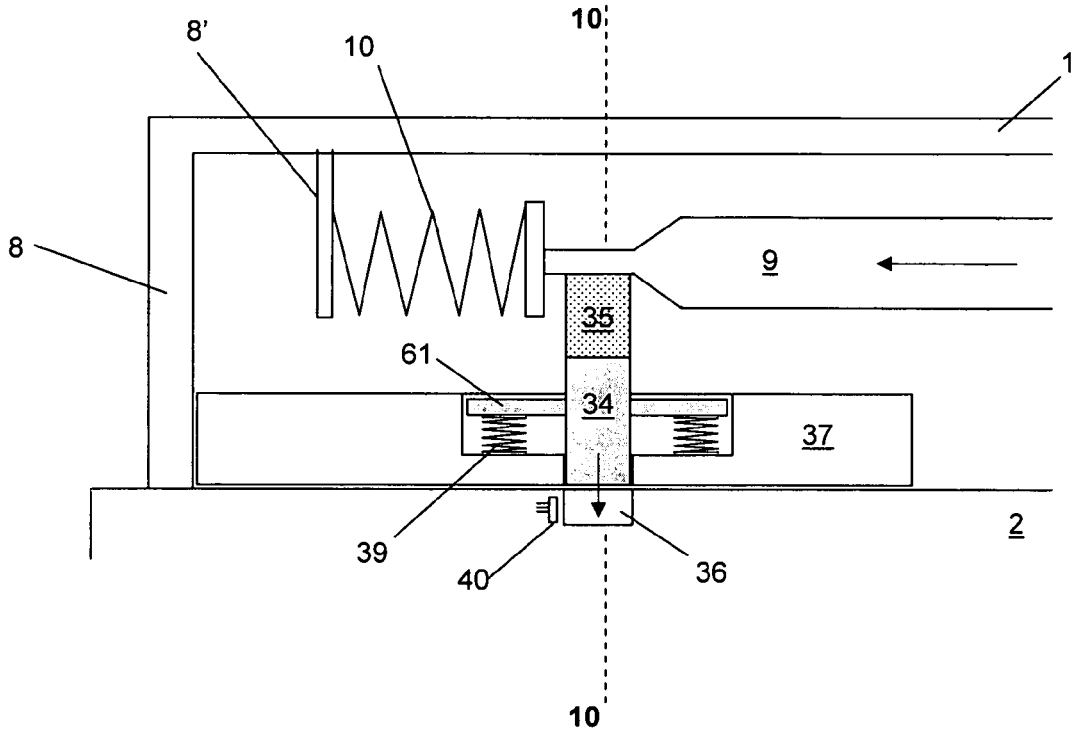
FIG. 9 is a longitudinal sectional view of the lock core with a coupling and drive pin in accordance with embodiments of the present invention.

With reference now to FIGS. 9 and 10, a coupling of the blocking cam 4 to the plug 2 will be described in accordance with an alternative embodiment of the present invention. In this particular embodiment, the blocking cam 4 includes a coupling pin 34 that is moved in a direction perpendicular to the motion of the actuator 9 rather than parallel to the motion of the actuator 9. Here a tapered actuator 9 is used to relay transverse motion to a drive pin 35, which in turn moves the coupling pin 34. The tapered actuator 9 depicted in FIG. 9 represents an actuator 9 of the type that is integral to the core. The coupling pin 34 is biased to a first position by a return bar 61 and return spring 39. When the actuator 9 is released, a restoring force is created by the spring 10 acting against the rear face 8 or a similar structure 8' connected to the shell 1. The assembly of the coupling pin 34, return bar 61, and return spring 39 are held fixed relative to the plug 2 in the longitudinal direction (i.e., the direction of travel of actuator 9) by a coupling core 37 and by the solid inner portion (not shown) of the shell 1. The coupling core 37 also functions to provide a mechanical connection between the interlocking pin 34 and the blocking cam 4.

Adequate movement of actuator 9 toward the rear face 8 will cause the drive pin 35 to move radially outward by an amount equal to the tapered dimensions of the actuator 9. Motion of the drive pin 35 is translated to the coupling pin 34 to move the coupling pin into the coupling pin receptacle 36 located at the outer periphery of the plug 2. A sensor 40 is used to detect the presence or removal of the coupling pin 34 in the coupling pin receptacle 36. When the presence of the coupling pin 34 is detected in the coupling pin receptacle 36, the sensor 40 along with the control unit 18 and electronic access control 15 invalidate general access credentials that are subsequently presented to the electronic access control 15 situated in the knob 5. This feature prevents holders of general credentials from inserting and/or removing the interchangeable lock core from its mating receptacle or housing. When the coupling pin 34 is in the second position such that rotation of the plug 2 will result in movement of the blocking cam 4, the control unit 18 and electronic access control 15 only permits rotation of the plug 2 when a control credential is presented to the electronic access control 15.

Figure 10A:
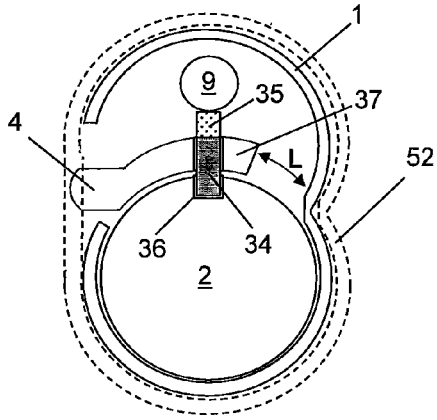
FIG. 10A is a cross-sectional view along line 10-10 with a blocking cam in a first position.
Figure 10B:
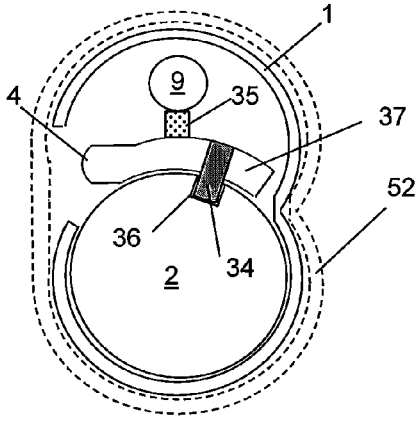
FIG. 10B is a cross-sectional view along line 10-10 with the blocking cam in a second position.

FIGS. 10A and 10B depict a cross-sectional view of line 10-10 of FIG. 9 with the coupling pin 34 engaged in the coupling pin receptacle 36. When the coupling pin 34 is restored to its static first position by the return spring 39 as depicted in FIG. 9, the coupling core 37 and thus the blocking cam 4 cannot rotate clockwise or counter-clockwise due to engagement of the coupling pin 34 and the drive pin 35 into a solid inner portion (not shown) of the shell 1. When the coupling core 37 is engaged to the plug 2 via the coupling pin 34, rotation of the plug 2 causes the blocking cam 4 to protrude from or retract into the shell 1. Rotation of the coupling core 37 and blocking cam 4 is mechanically limited to length L by physical contact against the solid inner surface (not shown) of the shell 1. Similar to previously described embodiments, when the blocking cam 4 is not retracted into the shell 1 (as shown in FIG. 10A), the blocking cam 4 is in its first position and the interchangeable lock core cannot be removed from the lock housing 38. When the blocking cam 4 is retracted into the shell 1 (as shown in FIG. 10B), the blocking cam 4 is in its second position and the interchangeable core can be removed from and inserted into the lock housing 38. Additionally, with the blocking cam 4 in this second position (FIG. 10B) the lock core may be removed to change batteries as is sometimes necessary with electronic devices. The lock core can then be inserted back into a housing 38 that was previously holding a mechanical lock core. The new electromechanical lock core can be inserted into the housing 38 and the blocking cam 4 can be moved to the locked position thus fixing it in the housing 38.

Figure 11:
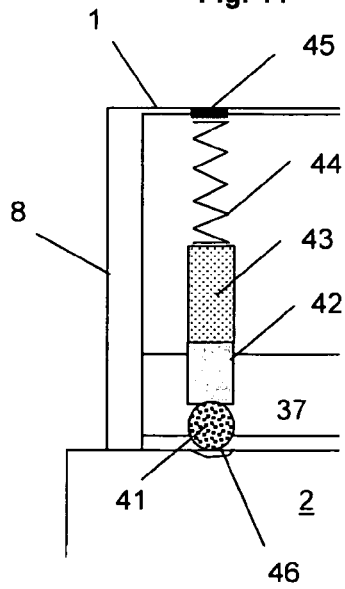
FIG. 11 is a longitudinal sectional view of a ball and pin assembly in accordance with embodiments of the present invention.

FIG. 11 depicts another assembly that can be used to secure and align the coupling core 37 in relation to the plug 2 and the inner solid surface (not shown) of the shell 1 in accordance with at least some embodiments of the present invention. The coupling core positioning assembly generally comprises a ball 41, an interlocking pin 42, a drive pin 43, an interlocking spring 44, and a cap 45. A ball recess 46 is located in the plug 2. When the plug 2 is rotated to a select position, the ball 41 engages the ball recess 46. The ball recess 46 and coupling pin receptacle 36 are collinear on the plug 2 to create a self-aligning index position for engagement of the coupling pin 34 with the coupling pin receptacle 36.

Rotation of the plug 2 in a non-select position causes the ball 41 to disengage the ball recess 46. The motion of the ball 41 away from the ball recess 46 and thus away from the center of the plug 2 is translated to an equivalent motion of the interlocking pin 42. The interlocking pin 42 moves the drive pin 43 acting to compress the interlocking spring 44. Given a fixed length interlocking pin 42 and fixed length drive pin 43, interference is created between the interlocking pin 42, the coupling core 37 and the inner solid surface (not shown) of the shell 1. This interference serves to stabilize the coupling core 37 relative to the shell 1. The positioning assembly can be adjusted or removed via the cap 45 located in proximity to the top of the shell 1.

Figure 12:
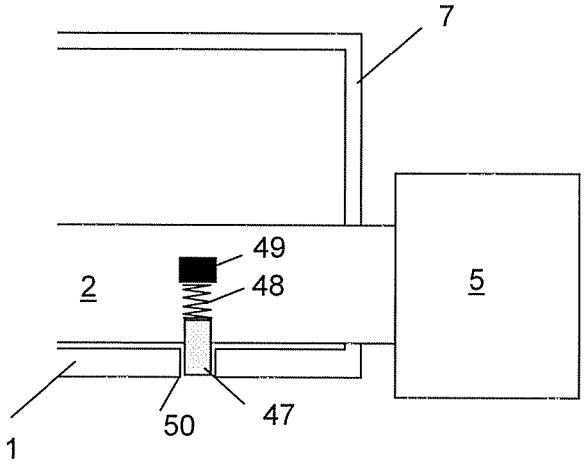
FIG. 12 is a longitudinal sectional view of an anti-tamper mechanism in accordance with embodiments of the present invention.

FIG. 12 depicts an anti-tampering assembly in accordance with at least some embodiments of the present invention. The lock core generally includes at least one anti-tampering assembly and preferably includes more than one anti-tampering assembly. An anti-tampering assembly generally includes an anti-tamper pin receptacle 50, an anti-tamper pin 47, an anti-tamper spring 48, and an anti-tamper actuator 49. The anti-tamper actuator 49 is in communication with the control unit 18 and the electronic access control 15. When loss of communication (e.g., via tampering or malicious attack) is realized between the anti-tamper actuator 49 the control unit 18 and electronic access control 15 of the knob 5, the anti-tamper actuator 49 is de-powered and the anti-tamper pin 47 is coupled with the anti-tamper pin receptacle 50. In one embodiment, the anti-tamper pin receptacle 50 is integral and fixed to the shell 1. There are number of the anti-tamper pin receptacles 50 located in the inner periphery of the shell 1. The anti-tamper spring 48 provides force or pressure to constantly couple the anti-tamper pin 47 with the anti-tamper receptacle 50. With the anti-tamper pin 47 coupled to the anti-tampering receptacle 50, rotation of the plug 2 and operating cam 6 are restricted via the non-rotatable shell 1. In this condition, the interchangeable lock core of the present invention cannot be used for additional attempt(s) at access into a secured area. Moreover, the blocking cam 4 is secured in its current position thus preventing the lock core from being removed from and inserted into the housing 52.

The present invention, in various embodiments, includes components, methods, processes, systems and/or apparatuses substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An interchangeable electromechanical lock core, comprising:

a plug;

a knob affixed to said plug, the knob comprising an access control reader; and a blocking cam having a first position and a second position, wherein when the blocking cam is in the first position the lock core is held securely within a lock housing, wherein when the blocking cam is in the second position the lock core is removeable from the lock housing, wherein, in a first state, the blocking cam is operatively disengaged from the plug and, in a second state, the blocking cam is operatively engaged with the plug, wherein the position of the blocking cam is controlled by rotation of the plug when the blocking cam is in the second state, wherein rotation of the plug is dependent upon the coupling between the plug and the knob, and wherein coupling between the plug and knob is selectively engaged only upon presentation of a valid control credential to the access control reader.

2. The lock core of claim 1, wherein said control credential comprises a contactless credential.

3. The lock core of claim 1, wherein said control credential comprises at least one of a smartcard, a proximity card, a key fob, a cellular phone, and a Personal Digital Assistant (PDA).

4. The lock core of claim 1, wherein when said valid control credential is not presented to the access control reader, said knob is freely rotatable about said plug.

5. The lock core of claim 1, further comprising a shell that contains the plug and blocking cam, wherein said first position of said blocking cam corresponds to a position where said blocking cam is not retracted into said shell, and wherein said second position of said blocking cam corresponds to a position where said blocking cam is retracted into said shell.

6. The lock core of claim 5, wherein when said blocking cam is in said second position said shell is removable from and insertable into the lock housing.

7. The lock core of claim 1, further comprising coupling means that are mechanically operable to selectively couple said blocking cam to said plug.

8. The lock core of claim 1, further comprising a sensor operable to detect that said blocking cam has been coupled to said plug.

9. The lock core of claim 7, wherein the coupling means comprise a coupling pin operable to be moved into said plug and upon moving said coupling pin into said plug, a spring controlling the position of said coupling pin is moved from a first position to a second position such that said blocking cam is in said second state and operatively engaged with said plug.

10. The lock core of claim 9, further comprising a sensor operable to detect a presence of said coupling pin in said plug, and upon detecting said presence to transmit a signal verifying that the blocking cam is coupled to the plug.

11. The lock core of claim 1, wherein said blocking cam is coupled to said plug via a coupling means that moves in a direction substantially parallel to a rotation axis of said plug.

12. The lock core of claim 1, wherein said blocking cam is coupled to said plug via a coupling means that moves in a direction substantially perpendicular to a rotation axis of said plug.

13. The lock core of claim 1, further comprising at least one anti-tampering assembly that includes an anti-tamper actuator in communication with a control unit and electronic access control, wherein when loss of communication is realized between the anti-tamper actuator the control unit and electronic access control, the anti-tamper actuator causes the rotation of the plug to be inhibited.

14. The lock core of claim 1, further comprising a security mechanism that has to be disengaged to authorize movement of said blocking cam.

15. A method of operating an interchangeable electromechanical lock core, comprising:

causing a blocking cam to move from a first state where it is decoupled from a plug to a second state where it is coupled to the plug;

presenting a valid control credential to a knob fixedly associated with said lock core along a first axis; and then while the blocking cam is coupled to the plug, moving said plug such that said blocking cam is moved from a first position in which the lock core is held securely within a lock housing, to a second position in which the lock core is removeable from said lock housing, wherein the movement of said plug is dependent upon a coupling between the plug and the knob and the coupling between the plug and the knob is engaged upon presentation of the valid control credential to the knob.

16. The method of claim 15, further comprising verifying an authenticity of said control credential prior to allowing movement of said plug.

17. The method of claim 15, further comprising restricting movement of said plug to instances only where a valid control credential is presented to said lock core.

18. The method of claim 15, further comprising:

detecting that said blocking cam has been coupled to said plug; and sending an electronic signal to a control unit and electronic access control that said blocking cam is coupled to said plug.

19. The method of claim 15, wherein movement of the plug is allowed by coupling a knob to said plug when a valid control credential is presented to said lock core and wherein causing said blocking cam to move from said first state to said second state includes placing a load on a spring.

20. A method of operating an interchangeable electromechanical lock core, comprising:

removing a first interchangeable lock core from a lock housing;

obtaining a second interchangeable lock core having a blocking cam, a plug, and an access control reader associated with a knob affixed to said plug;

inserting said second interchangeable lock core into said lock housing;

presenting a valid control credential to said reader;

coupling the plug with the knob when the valid control credential is presented to the reader;

coupling the blocking cam with the plug; and rotating the knob while the plug is coupled with the knob and the blocking cam is coupled with the plug, thereby moving said plug such that said blocking cam is in a second position wherein rotation of the plug is dependent upon the coupling between the plug and knob.

21. The method of claim 20, wherein said second position causes said second interchangeable lock core to be substantially fixed within said lock housing.

22. The method of claim 20, wherein said blocking cam is moved by said plug only after said valid control credential is presented to said reader and is recognized by said reader.

* * * * *